US010738568B2

(12) United States Patent
Nanney et al.

(10) Patent No.: US 10,738,568 B2
(45) Date of Patent: Aug. 11, 2020

(54) DELAYED FIN DEPLOYMENT WIPER PLUG

(71) Applicant: ConocoPhillips Company, Houston, TX (US)

(72) Inventors: James G. Nanney, Houston, TX (US); Matthew L. White, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 71 days.

(21) Appl. No.: 16/033,196

(22) Filed: Jul. 12, 2018

(65) Prior Publication Data

US 2019/0017348 A1 Jan. 17, 2019

Related U.S. Application Data

(60) Provisional application No. 62/532,762, filed on Jul. 14, 2017.

(51) Int. Cl.

| | |
|---|---|
| ***E21B 33/16*** | (2006.01) |
| ***E21B 37/04*** | (2006.01) |
| ***E21B 33/14*** | (2006.01) |

(52) U.S. Cl.

CPC ..... *E21B 33/16* (2013.01); *E21B 33/14* (2013.01); *E21B 37/04* (2013.01); *E21B 37/045* (2013.01)

(58) Field of Classification Search

CPC ..... E21B 33/16; E21B 37/04; E21B 37/045; E21B 33/14

See application file for complete search history.

(56) References Cited

U.S. PATENT DOCUMENTS

| | | | | |
|---|---|---|---|---|
| 4,078,810 | A | 3/1978 | Arendt | |
| 5,890,537 | A * | 4/1999 | Lavaure | E21B 33/16 166/156 |
| 8,327,930 | B2 * | 12/2012 | Rondeau | E21B 33/05 166/153 |
| 8,327,937 | B2 * | 12/2012 | Giem | E21B 33/136 166/153 |
| 8,622,131 | B2 * | 1/2014 | Giem | E21B 33/136 166/156 |
| 8,960,283 | B2 * | 2/2015 | Rondeau | E21B 34/14 166/156 |
| 9,085,952 | B2 * | 7/2015 | Rondeau | E21B 23/00 |
| 2002/0033261 | A1 | 3/2002 | Metcalfe | |
| 2002/0144812 | A1 | 10/2002 | Smith | |
| 2012/0090835 | A1 * | 4/2012 | Kefi | E21B 27/02 166/252.6 |
| 2012/0234561 | A1 | 9/2012 | Hall | |
| 2013/0014948 | A1 | 1/2013 | Gambier | |
| 2018/0051533 | A1 | 2/2018 | Zbranek et al. | |

OTHER PUBLICATIONS

Search Report for PCT/US18/041803, dated Sep. 13, 2018.

* cited by examiner

*Primary Examiner* — Nicole Coy
(74) *Attorney, Agent, or Firm* — Boulware & Valoir

(57) ABSTRACT

A delayed fin deployment wiper plug has a tubular body, which has a closed top and a piston therein. The piston is supported at one or more locations inside the tubular body by one or more sets of shear pins or spring clips or some equivalent device. The piston is connected to or abutted to a sleeve that covers an upper portion of the tubular body, containing therein one or more sets of deployable fins that are not exposed for use unless the piston is activated and raises the sleeve.

12 Claims, 7 Drawing Sheets

DELAYED FIN DEPLOYMENT WIPER PLUG

PRIOR RELATED APPLICATIONS

This application claims priority to U.S. Provisional Application No. 62/532,762, filed Jul. 14, 2017, the disclosure of which is expressly incorporated herein by reference in its entirety for all purposes.

FIELD OF THE DISCLOSURE

The disclosure generally relates to devices for use in downhole cementing operations, their design, manufacture, deployment, and use.

BACKGROUND OF THE DISCLOSURE

Before any well drilling is initiated, engineers create a well plan and architectural diagram, showing the hole and casing sizes needed to drill the well to its desired depth. A typical wellbore architectural diagram for an onshore well is shown in FIG. 1. Normal drilling operations include drilling the hole and adding new joints of pipe, one at a time, as the hole deepens. It also involves "tripping" the drill string all the way out of the hole to put on a new bit and then running it back to the bottom (making a round trip). Other key steps include running and cementing the large-diameter steel casing used to seal selected intervals of the hole.

It is standard practice to drill a well bore of large diameter to a certain depth and then line the drilled well bore with a casing, which is cemented in place. This is sometimes called surface casing. Thereafter, smaller size bits and casing are used, and the borehole is continued, again cementing the intermediate casing in place. This step can be repeated several times with decreasing diameter pipe, depending on the depth of the well. Thus, a borehole is comprised of a series of borehole sections of decreasing diameter, each having a string of pipe cemented in place. Eventually, the hydrocarbon-containing zone is reached, and that section of well typically contains slotted liner, the small slots or holes allowing the entry of oil.

In the case of the single stage cementing operation, the casing with all of the required cementing accessories such as the float collar, centralisers, and the like is run into the hole until the shoe is just a few feet off the bottom of the hole and the casing head is connected to the top of the casing. It is essential that the cement plugs are correctly placed in the cement head. The casing is then circulated to clean it before the cementing operation begins. At least one casing volume should be circulated to clean the well and annular space of drilling mud, which can contaminate and compromise the cement. The first cement plug (wiper plug), is pumped down ahead of the cement to wipe the inside of the casing clean. The spacer is then pumped into the casing. The spacer is followed by the cement slurry, and this is followed by the second plug (shut-off plug). FIG. 2 shows a variety of bottom and top wiper plug styles.

When a bottom wiper plug with rupturable diaphragm, as shown in FIG. 3, reaches the float collar, its rubber diaphragm is ruptured, allowing the cement slurry to flow through the plug, around the shoe, and up into the annulus. At this stage, the spacer provides a barrier to mixing of the cement and mud. When the solid, shut-off plug reaches the float collar it lands on the wiper plug and stops the displacement process. The pumping rate should be slowed down as the shut-off plug approaches the float collar and the shut-off plug should be gently bumped into the bottom, wiper plug. The casing is often pressure tested at this point in the operation.

The pressure is then bled off slowly to ensure that the float valves, in the float collar and/or casing shoe, are holding. The displacement of the top plug is closely monitored, and the volume of displacing fluid necessary to bump the plug is calculated before the job begins. When the pre-determined volume has almost been completely pumped, the pumps are slowed down to avoid excessive pressure when the plug is bumped. If the top plug does not bump at the calculated volume (allowing for compression of the mud) this may be because the top, shut-off plug has not been released. If this is the case, no more fluid should be pumped, since this would displace the cement around the casing shoe and up the annulus. Throughout the cement job, the mud returns from the annulus should be monitored to ensure that the formation has not been broken down. If formation breakdown does occur, then mud returns would slow down or stop during the displacement operation.

One problem with prior art wiper plugs is fin degradation. Because the wiper plug material is in contact with the inner diameter of the tubular, it experiences wear that can cause the fins to degrade and eventually fail. Failed fins will not wipe the pipe clean, leaving fluids and/or debris behind, causing problems for future well operations. Debris left inside the casing can plug up tools or perforations during completion operations, cause wear on tools, and impede flow.

Previous attempts to correct this problem have simply used more fins in the hope that they will not wear out before the operation is completed. However, the fins are still subject to the same wearing forces, and still tend to degrade at roughly the same rate, even if more are present. Another solution is to use more durable materials for the fins. However, the fins still need to be flexible to achieve their intended purposes and to traverse through less than perfect tubing, and thus there is a limit on how durable the fin material can be. Further, more durable materials still degrade, and this solution only delays the onset of the problem.

Thus, what is needed in the art are better wiper plugs that can provide additional and better wiping, especially closer to the tail end of the well bore where prior art fins have already degraded by the time they reach the tail end.

SUMMARY OF THE DISCLOSURE

During cementing operations, a wiper plug is typically used to act as a solid barrier between different fluid types to prevent contamination between them. Because the wiper plug material is in contact with the inner diameter of the tubular, the fins experience wear leading to eventual failure. The solution described herein allows for fresh fins to be deployed on a given wiper plug, even while downhole, and contact the tubular inner diameter at some time after the plug has been deployed.

The tool utilizes a blocking sleeve and atmospheric chamber to protect one or more wiping fins from wear until a time when wear is apparent, and the sleeve shifts, thus exposing new fins for use. These new "fresh" fins allow for better cleaning as opposed to the ones that have been undergoing wear through the previous length of tubular.

The atmospheric chamber works off absolute pressure. Wellbore pressure is acting on one side of the piston with atmospheric pressure trapped on the other side. Shear activation is set based on the desired true vertical depth of activation. Upon reaching a desired position in the well bore either through monitoring flow rate and calculating position, or after a prescribed period of time, or through changes in pressure and resistance, the pump rate is dropped, and decreased pressure allows the atmospheric chamber to expand, shearing the retaining pins. Once the pins are sheared the sleeve shifts to a second position releasing the fins. The released fins contact the well bore and provide a clean wipe. The pressure impulses can also be reversed.

The blocking sleeve is attached to some type of piston with an atmospheric chamber on one side. The piston is held in place with shear screws or any other removable element. When the plug reaches a point that the hydrostatic pressure exerts a force great enough to shear the screws the piston moves shifting the blocking sleeve and exposing the second set of fins. The number and type of shear screws can be adjusted allowing the depth at which it activates to be customized for each application. The second set of fins compensates for any wear on the original set and increases the overall wiping efficiency of the plug system.

If desired, the shear mechanism can be repeated for multiple sets of fins, housed inside the same, albeit longer, sleeve. Different shear strength retaining pins can be activated at different pressures, thus allowing sequential deployment of additional fins.

Each protected set of fins sits underneath a sleeve, and the sleeve must clear the inner diameter of the wellbore and thus the sleeve is of smaller diameter than the fins themselves. The fins are thus compressed or bent somewhat inside the sleeve.

This solution allows for new fresh fins to be engaged against the casing, e.g., just before the plug enters the curve/lateral of a well. These fresh fins have not experienced any type of wear, having been protected by the outer sleeve. Once deployed, they will be fresh and have much better wiping efficiency, thus reducing the risk of cement or other debris being left behind.

A wiper plug with a second or more deployable fins sets could be used in any wellbore cementing operation where debris left in the casing would be detrimental to future operations. In the case of horizontal wells with toe initiator valves, the debris left by conventional wiper plugs can clog the tool and render it useless. This invention would further reduce the debris or eliminate it completely, allowing for a higher rate of success.

As used herein a "removable connector" is one that holds the piston at a set location and that can be removed downhole, without tripping the wiper plug out of the hole. Such devices include shear pins, spring clips, dissolvable retainers, rupture disks, electronically actuated retainers, timed retainers, gas actuated retainers, powder actuated retainers, and the like, as well as combinations thereof.

As used herein a "shearable connector" is a removable connector that is activated under pressure by shearing the connector into two parts. Such devices include shear pins, shear screws, shear bolts, shear rivets, and the like.

By "flexible" fins what is meant is that the material has enough flexibility to be housed inside a smaller diameter sleeve, and then expand when the sleeve is removed. The material also has enough flex to provide an adequate wiping surface when traversing a pipe that is being cleaned. They may also need to be able to reverse without breaking. A suitable durometer is about 60-80 Shore A.

Common fin materials include synthetic polyisoprene, chloroprene, ethylene, propylene, butadiene acrylonitrile, polybutadiene, isobutylene isoprene, and the like. Shore A hardness is carried out according to ASTM D 2240. Exemplary fins are 75 Shore A HNBR (Hydrogenated Nitrile) or 65 Shore A SBR (Styrene Butadiene).

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed and excludes all additional elements.

The phrase "consisting essentially of" excludes additional material elements but allows the inclusions of non-material elements that do not substantially change the nature of the invention, such as instructions for use, additional connectors and the like.

The abbreviation "HNBR" means hydrogenated nitrile butadiene rubber.

The abbreviation "SBR" means styrene butadiene rubber.

DETAILED DESCRIPTION

Figure 1:
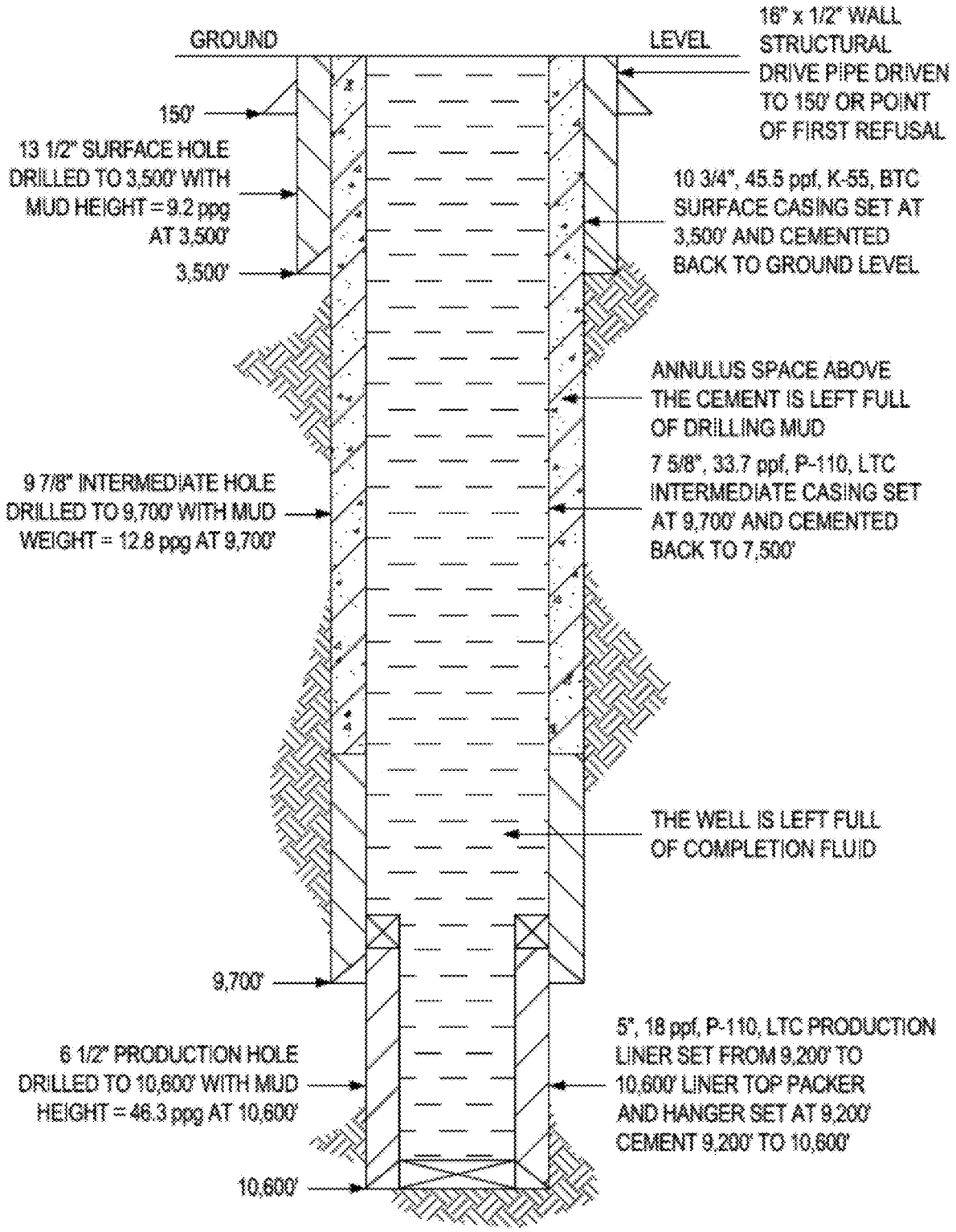
(PRIOR ART) FIG. 1
FIG. 1 is a prior art well architectural diagram showing decreasing diameter with depth and cemented intervals.
Figure 2:
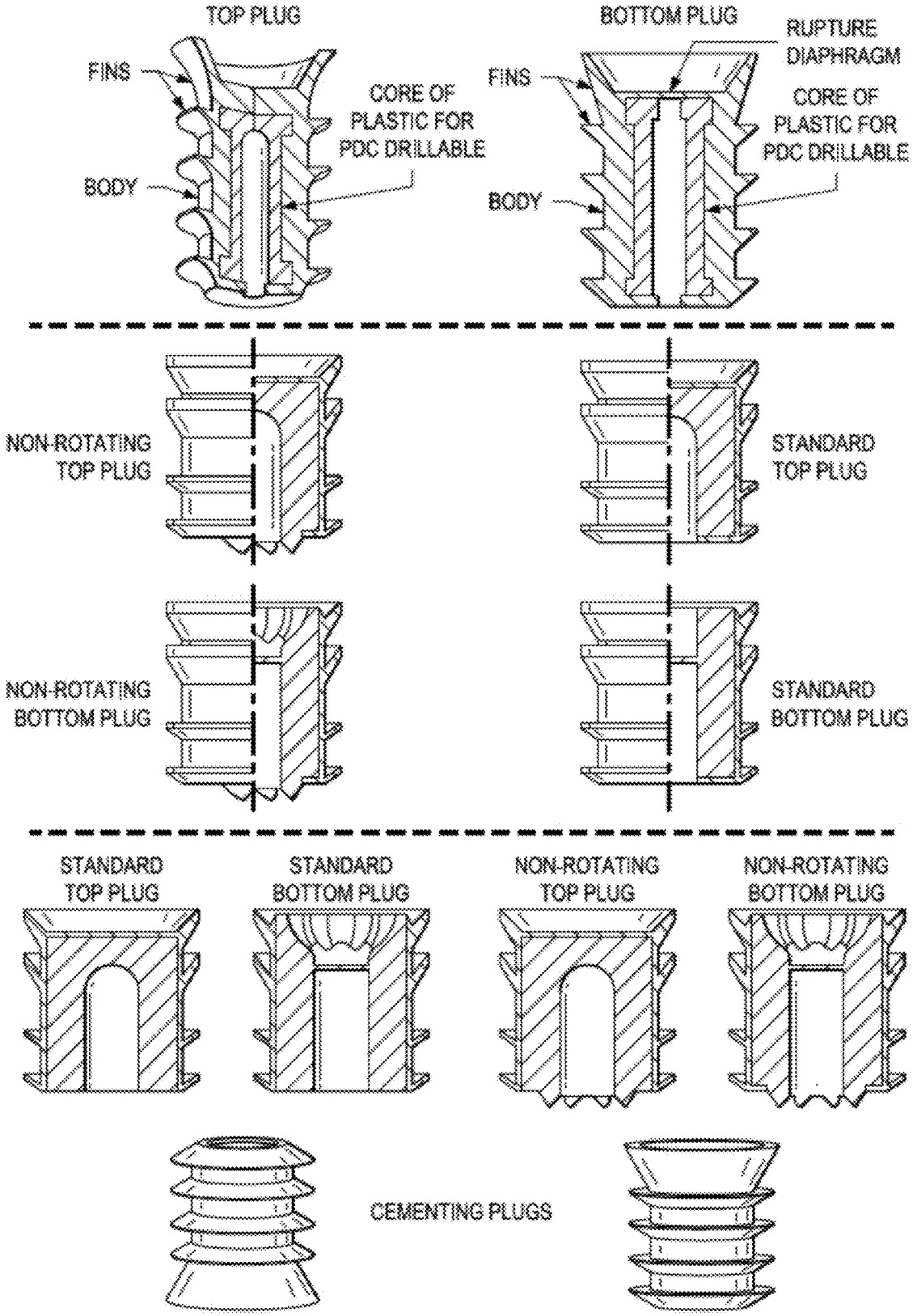
(PRIOR ART) FIG. 2
FIG. 2 shows a variety of different prior art wiper plugs.
Figure 3:
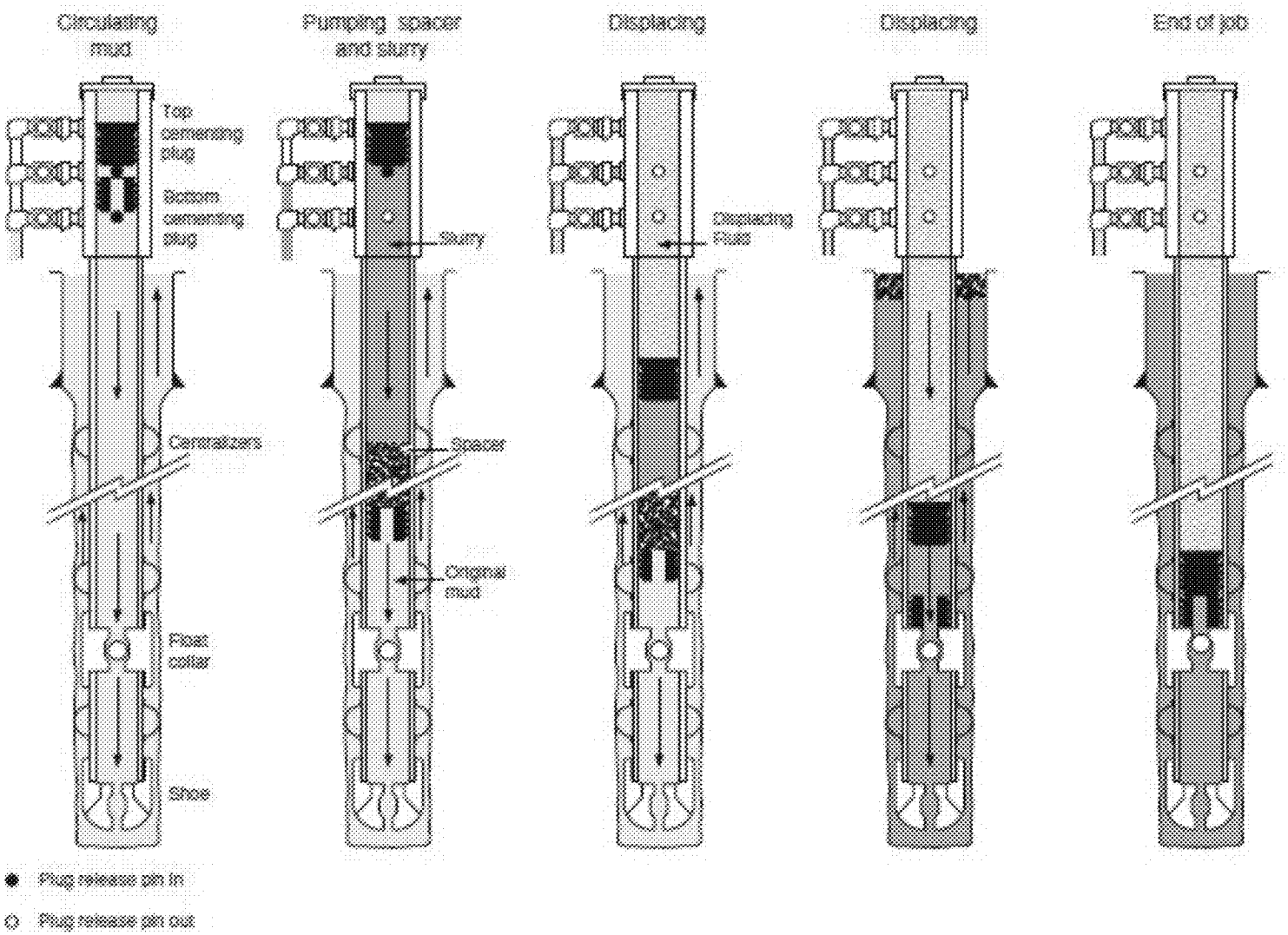
(PRIOR ART) FIG. 3
FIG. 3 shows a prior art wiper plug used in single stage cementing operation.

The disclosure provides novel wiper plugs with a second (or more) set(s) of wiper fins that are deployable on command. Generally speaking, the wiper plug has a piston that can be activated to raise a sleeve, under which are housed one or more additional fin sets. When the piston is activated, it lifts, raising the sleeve and exposing the fins that were previously hidden inside the sleeve.

The piston can be activated in any suitable manner, and one common means would be to allow changing pressure to raise the sleeve, e.g., by shearing shear pins, screws, bolts and the like, or by overcoming the holding pressure of a spring clip, or other equivalent device. Other activation methods include timer activated, airbag activated, dissolvable retainer, deterioration of a retaining ring, deterioration of retaining wiper fins, and the like.

The invention includes any one or more of the following embodiment(s), in any combination(s) thereof:

In at least one embodiment, a delayed fin deployment wiper plug includes a tubular body having an open base and a closed top, the closed top having a hole therethrough, and the tubular body having a first set of a plurality of flexible fins circumnavigating a circumference of an exterior surface at a lower end of the tubular body. The delayed fin deployment wiper plug further includes a piston slidingly fitted through the hole, the piston including a piston rod and a piston base, the piston base supported at a first location inside the tubular body by one or more reversible connectors, and the piston rod and piston base and closed top forming a compression chamber inside an upper portion of the tubular body. The delayed fin deployment wiper plug further includes a sleeve over the upper portion of the tubular body, the sleeve having an open base and a closed sleeve top, and the piston rod abutting or connected to the closed sleeve top. The delayed fin deployment wiper plug further includes a second set of a plurality of flexible fins circumnavigating a circumference of an exterior surface at the upper end of the tubular body and contained within the sleeve, the sleeve being of smaller diameter than a diameter of deployed fins.

In at least one embodiment, a delayed fin deployment wiper plug includes a tubular body having an open base and a closed top, the closed top having a hole therethrough, and the tubular body having a first set of a plurality of flexible fins circumnavigating a circumference of an exterior surface at a lower end of the tubular body. The delayed fin deployment wiper plug further includes a piston slidingly fitted through the hole, the piston including a piston rod and a piston base, the piston base supported at a first location inside the tubular body by one or more reversible connectors, and the piston rod and piston base and closed top forming a compression chamber inside an upper portion of the tubular body. The delayed fin deployment wiper plug further includes a sleeve over the upper portion of the tubular body, the sleeve having an open base and a closed sleeve top, and the piston rod abutting or connected to the closed sleeve top. The delayed fin deployment wiper plug further includes a second set of a plurality of flexible fins circumnavigating a circumference of an exterior surface at the upper end of the tubular body and contained within the sleeve, the sleeve being of smaller diameter than a diameter of deployed fins.

In at least one embodiment, a delayed fin deployment wiper plug includes a tubular body having a closed top having a hole therethrough, the tubular body having a first set of a plurality of flexible fins circumnavigating a circumference of an exterior surface at a lower portion of the tubular body. The delayed fin deployment wiper plug further includes a piston slidingly fitted through the hole, the piston including a piston rod and a piston base, and the piston base supported at a first location inside the tubular body by a first set of reversible connectors. The delayed fin deployment wiper plug further includes a second set of reversible connectors above the first set of reversible connectors, the second set of reversible connectors having a higher shear strength than the first set of reversible connectors, and the piston rod and piston base and closed top forming a compression chamber inside an upper portion of the tubular body. The delayed fin deployment wiper plug further includes a sleeve over the upper portion of the tubular body, the sleeve having an open base and a closed sleeve top, and the piston rod abutting or connected to the sleeve top. The delayed fin deployment wiper plug further includes a second set of a plurality of flexible fins circumnavigating a circumference of an exterior surface of the upper portion of the tubular body and contained within the sleeve, above the first set of reversible connectors. The delayed fin deployment wiper plug further includes a third set of a plurality of flexible fins circumnavigating a circumference of an exterior surface of the upper portion of the tubular body and contained within the sleeve, above the second set of reversible connectors.

In any wiper plug herein, the reversible connectors may be selected from spring clips, shear pins, shear screws, shear bolts, or an equivalent.

In any wiper plug herein, the fins may be upwardly angled fins.

In any wiper plug herein, the fins may be upwardly angled fins comprising an elastomeric material.

In any wiper plug herein, the fins may be upwardly angled fins, and the fins and the tubular body may comprise an elastomeric material.

In any wiper plug herein, the fins may be upwardly angled fins and may comprise an elastomeric material, and the tubular body may comprise a metal interior surface.

In any wiper plug herein, the sleeve and the piston may comprise metal.

In any wiper plug herein, the fins may be upwardly angled fins and comprise an elastomeric material, the tubular body may comprise a metal interior surface, and the sleeve and piston may comprise metal.

In at least one embodiment, a delayed fin deployment wiper plug includes a wiper plug having a tubular body having a closed top and a piston therein, the piston being connected to or abutting a sleeve that covers an upper portion of the tubular body and houses therein one or more sets of deployable fins that are not exposed for use until the piston is activated and raises the sleeve.

In any wiper plug herein, the piston may be supported at one or more positions inside the tubular body by one or more sets of shearable connectors, and a change in pressure shears the shearable connectors and raises the sleeve.

In any wiper plug herein, the wiper plug may have two sets of shearable connectors, and an upper set of shearable connectors requires more force to shear than a lower set of shearable connectors.

In any wiper plug herein, the shearable connector may be a shear spin, a shear screw, or a shear bolt, or an equivalent.

In at least one embodiment, wiper plugs include a tubular body having a plurality of upwardly angled fins circumnavigating an exterior surface of the tubular body, where the improvement in the wiper plugs includes a piston in an upper portion of the tubular body, the piston being connected to or abutting a sleeve that covers the upper portion of the tubular body and houses therein at least one second set of deployable fins that are not exposed for use until the piston is activated and raises the sleeve.

In any wiper plug herein, the wiper plug may further include holding means for holding the piston at one or more locations along the tubular body and means for selectively removing or deactivating the holding means.

In any wiper plug herein, the wiper plug includes first holding means and second holding means above the first holding means, and the first holding means is removed or deactivated when a pressure exceeds a first pressure threshold, and the second holding means is removed or deactivated when a pressure exceeds a second pressure threshold higher than the first pressure threshold.

In at least one embodiment, a method of cleaning a wellbore includes deploying the wiper plug herein in a wellbore at a first pressure to clean a first portion of wellbore, changing the pressure, and deploying the second set of a plurality of flexible fins to clean a second portion of the wellbore. This can be repeated with a third set of fins cleaning a third portion of the wellbore. The method can be used in any of a variety of downhole procedures, such as cementing a casing, plug and abandonment, pigging, and the like.

In at least one embodiment, a method of cleaning a wellbore includes pumping a fluid through a wellbore at a first pump rate and deploying a delayed fin wiper plug into the wellbore. The delayed fin wiper plug includes: a tubular body having an open base and a closed top, the closed top having a hole therethrough, the tubular body having a first set of a plurality of flexible fins circumnavigating a circumference of an exterior surface at a lower end of the tubular body, the first set of fins cleaning a first portion of the wellbore at a first pump rate; a piston slidingly fitted through the hole, the piston including a piston rod and a piston base, the piston base supported at a first location inside the tubular body by one or more reversible connectors, the piston rod and piston base and closed top forming a compression chamber inside an upper portion of the tubular body; a sleeve over the upper portion of the tubular body, the sleeve having an open base and a closed sleeve top, the piston rod abutting or connected to the closed sleeve top; a second set of a plurality of flexible fins circumnavigating a circumference of an exterior surface at the upper end of the tubular body and contained within the sleeve, the sleeve being of smaller diameter than a diameter of deployed fins. The method further includes pumping the fluid at a second lower rate thereby decreasing the pressure in the wellbore and thereby removing the one or more reversible connectors. The method further includes expanding the compression chamber sliding the sleeve off of the second set of flexible fins, wherein the second set of fins cleans a second portion of the wellbore.

Figure 4:
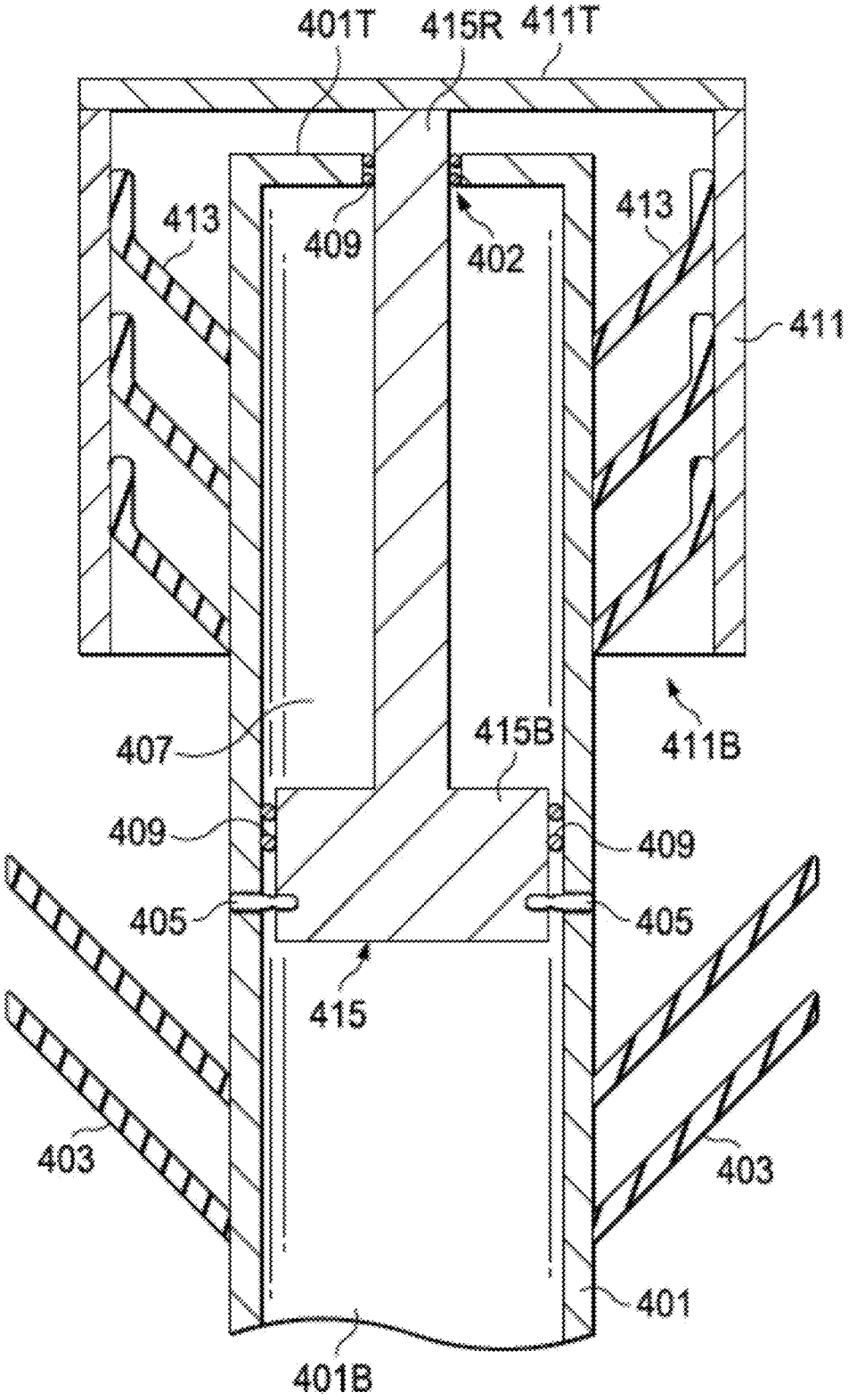
FIG. 4 is a cross-sectional view of a deployable fin wiper plug.

FIG. 4 shows a cross section of the deployable fin wiper plug. The tubular body 401 has an open base 401B and a closed top 401T, with a hole 402 therethrough.

Hole 402 is sized to allow piston rod 415R to slidably fit therethrough. Piston base 415B and piston rod 415R together make up piston 415, and the chamber being formed by the piston base 415B, piston rod 415R and tubular body top 401T being an atmospheric or compressible chamber 407.

A second set of fins 413 is found under sleeve 411, which also has an open base 411B and closed top 411T. The second set of fins is compressed or bent inside the sleeve 411, which is of smaller diameter that the first set of fins 403 in an open position. Of course, the sleeve 411 must also be of smaller diameter than the casing or tubing being wiped.

Figure 5:
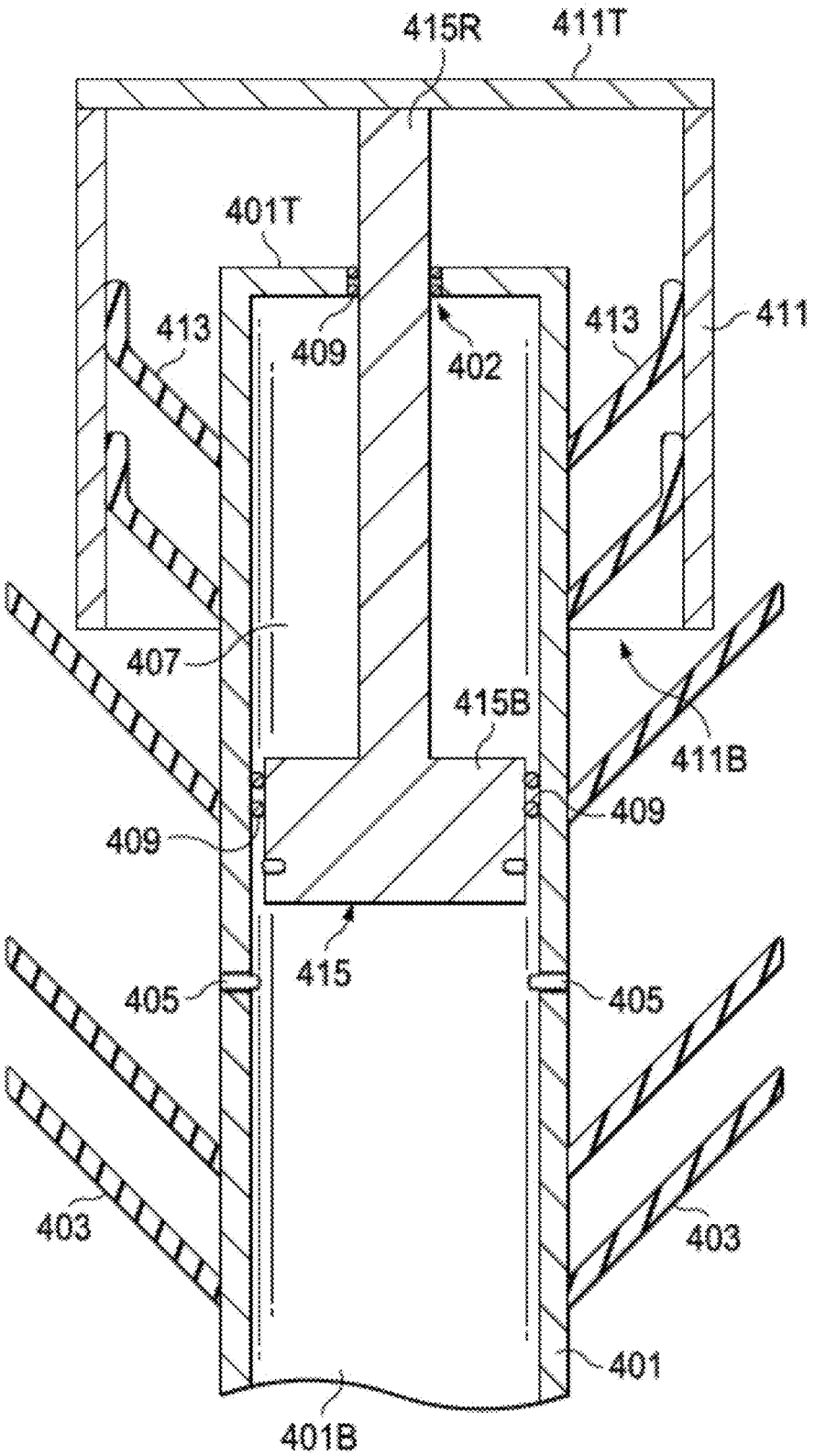
FIG. 5 shows the wiper plug of FIG. 4 with a second set of fins deployed.

Bearings 409 allow the piston to slide up and down, but other means, such as grease, could be used. Shear pins 405 are sheared under sufficient pressure, thus raising the sleeve 411 and allowing the second set of fins 413 to deploy. FIG. 5 shows the pins 405 sheared off, and the pressure thus raising the base of the piston 415B, and thereby raising sleeve 411 and exposing the fresh fins 413, which now no longer being constrained can straighten to meet the casing wall, thus providing the wiping action.

Piston 415 and sleeve 411 can be a single integrated piece or can be two or more pieces operably coupled in a more or less permanent manner or can be reversibly coupled. They could also be two or more separate pieces.

The outer body is dimensioned to accommodate a small range of casing inner diameters. In addition, we have shown the cross-sectional shapes of the tubing as cylindrical, but the inner surface could be any shape, such as a square, pentagon, hexagon. However, most if not all oil wells and casings are tubular.

Figure 6:
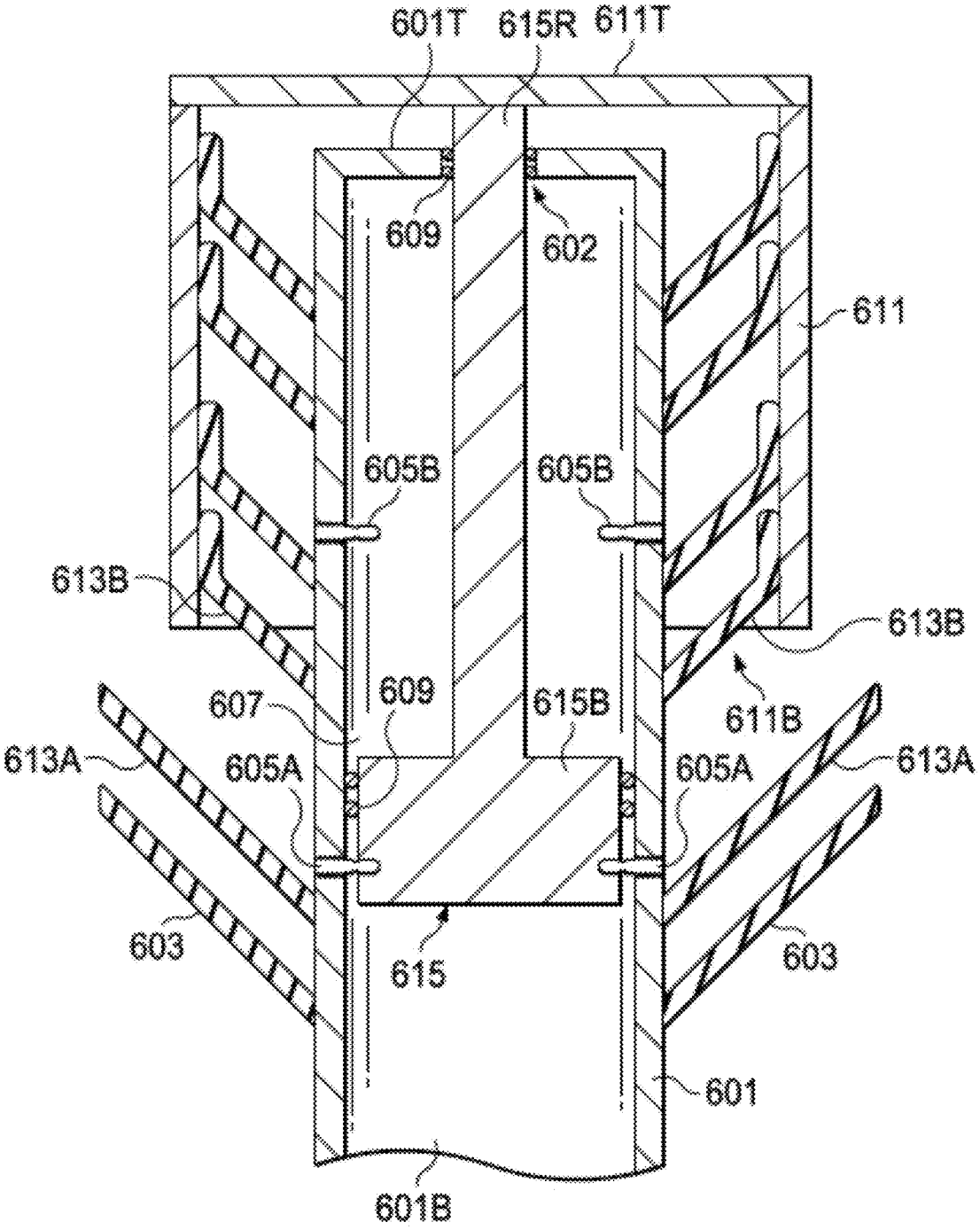
FIG. 6 is a cross-sectional view of a wiper plug with second and third sets of fins that can be sequentially deployed at, for example, changing pressure.

FIG. 6 shows a second embodiment with two sets of shear pins, allowing first and second delayed deployments of fins. The tubular body 601 has an open base 601B and a closed top 4601T, with a hole 602 therethrough.

Hole 602 is sized to allow piston rod 615R to slidably fit therethrough. Piston base 615B and piston rod 615R together make up piston 615, and the chamber being formed by the piston base 615B, piston rod 615R and tubular body top 601T being an atmospheric or compressible chamber 607.

A set of fins 613A is always deployed. A second set of fins 613B and a third set 613C are found under sleeve 611, which also has an open base 611B and closed top 611T, and the second and third sets of fins are compressed or bent inside the smaller diameter sleeve 611.

Figure 7:
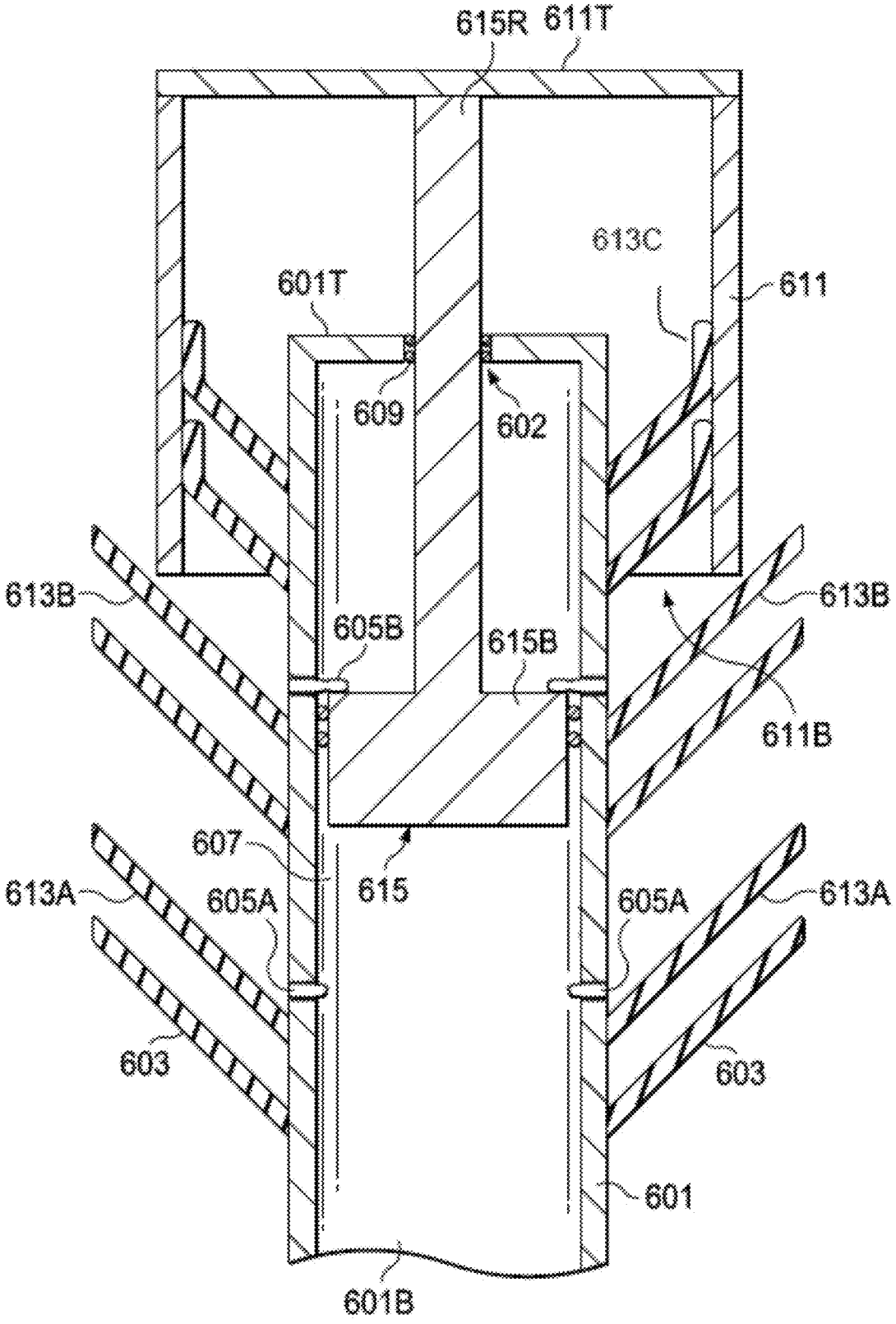
FIG. 7 is a cross-sectional view of the wiper plug of FIG. 6 shown with a second set of fins deployed, but with a third set of fins still housed inside the protective sleeve.

Bearings 609 allow the piston to slide up and down, and here two sets of shear pins 605A and 605B are provided, the lower set 605A shearing under lower pressure than the upper set 605B. Thus, at a first pressure, the first set 605A shears and the sleeve 611 raises, exposing the second set of fins 613A to deploy, and the piston is stopped by the second set of shear pins 605B. See FIG. 7. At a second higher pressure, the pins 605B shear off, thus raising the base of the piston 615B, and thereby raising sleeve 611 the rest of the way to expose the third set of fins 613B. This action can be repeated a plurality of times.

The shear pins are exemplary only and other removable connectors could be used instead, such as spring clips, shear screws, shear bolts, rivets, and the like.

With regard to materials suitable for the invention, a number of different ones may serve. For the fins, a generally resilient material, such as many different types of elastomers, polyvinyls, and rubbers well known in the relevant art may be used. Other plastics known in the art may serve as well.

The tubular body can be the same material or a metal or can have a metal interior surface. Indeed, many wiper plugs have an aluminum core, and hard rubber or other resin exterior. The sleeve and piston are typically made of metal, such as aluminum or steel.

A very simple plug style has been provided herein, but the plug can have any of the further modifications known in the art, such as stiffening rods inside the fins, plug connectors, and the like.

In use, the wiper plug is used in any downhole application, being deployed down hole to wipe clean an inner surface of well tubing and removing any removable connector or holding means when it is time to deploy a set of fresh fins. Where the holding means are pressure activated, a first set of fresh fins is deployed by at least temporarily providing a pressure high enough to raise the piston. Additional sets of fins can be deployed by at least temporarily providing a pressure high enough to again raise the piston, and typically, each subsequent deployment requires increased pressure.

The invention claimed is:

1. A delayed fin deployment wiper plug, said wiper plug comprising;

(a) a tubular body having an open base and a closed top;

(b) said closed top having a hole therethrough;

(c) said tubular body having a first set of a plurality of flexible fins circumnavigating a circumference of an exterior surface at a lower end of said tubular body;

(d) a piston slidingly fitted through said hole, said piston comprising a piston rod and a piston base;

(e) said piston base supported at a first location inside said tubular body by one or more reversible connectors;

(f) said piston rod and piston base and closed top forming a compression chamber inside an upper portion of said tubular body;

(g) a sleeve over said upper portion of said tubular body, said sleeve having an open base and a closed sleeve top;

(h) said piston rod abutting or connected to said closed sleeve top;

(i) a second set of a plurality of flexible fins circumnavigating a circumference of an exterior surface at said upper end of said tubular body and contained within said sleeve; and (j) said sleeve being of smaller diameter than a diameter of deployed fins.

2. The wiper plug of claim 1, wherein said fins are upwardly angled fins.

3. The wiper plug of claim 1, wherein said fins are upwardly angled fins comprising an elastomeric material.

4. The wiper plug of claim 1, wherein said fins are upwardly angled fins and said fins and said tubular body comprise an elastomeric material.

5. The wiper plug of claim 1, wherein said fins are upwardly angled fins and said fins comprise an elastomeric material and said tubular body comprise a metal interior surface.

6. The wiper plug of claim 1, wherein said sleeve and said piston comprise metal.

7. The wiper plug of claim 1, wherein said fins are upwardly angled fins and said fins comprise an elastomeric material and said tubular body comprised a metal interior surface and said sleeve and said piston comprise metal.

8. A method of cleaning a wellbore, comprising deploying the wiper plug of claim 1 in a wellbore at a first pressure to clean a first portion of wellbore, changing said pressure, and deploying said second set of a plurality of flexible fins to clean a second portion of said wellbore.

9. A delayed fin deployment wiper plug, said wiper plug having a tubular body having a closed top and a piston therein, the piston being connected to or abutting a sleeve that covers an upper portion of said tubular body and houses therein one or more sets of deployable fins that are not exposed for use until said piston is activated and raises said sleeve, wherein said piston is supported at one or more positions inside said tubular body by one or more sets of shearable connectors, and high pressure shears said shearable connectors and raises said sleeve.

10. The wiper plug of claim 9, wherein said wiper plug has two sets of shearable connectors, and an upper set of shearable connectors requires more force to shear than a lower set of shearable connectors.

11. The wiper plug of claim 10, wherein said shearable connector is a shear pin, shear screw, or a shear bolt.

12. A method of cleaning a well bore comprising:

(a) pumping a fluid through a wellbore at a first pump rate;

(b) deploying a delayed fin wiper plug into said wellbore, said delayed fin wiper plug comprising:

i) a tubular body having an open base and a closed top;

ii) said closed top having a hole therethrough;

iii) said tubular body having a first set of a plurality of flexible fins circumnavigating a circumference of an exterior surface at a lower end of said tubular body, said first set of fins cleaning a first portion of said wellbore at said first pump rate;

iv) a piston slidingly fitted through said hole, said piston comprising a piston rod and a piston base;

v) said piston base supported at a first location inside said tubular body by one or more reversible connectors;

vi) said piston rod and piston base and closed top forming a compression chamber inside an upper portion of said tubular body;

vii) a sleeve over said upper portion of said tubular body, said sleeve having an open base and a closed sleeve top;

viii) said piston rod abutting or connected to said closed sleeve top;

ix) a second set of a plurality of flexible fins circumnavigating a circumference of an exterior surface at said upper end of said tubular body and contained within said sleeve; and x) said sleeve being of smaller diameter than a diameter of deployed fins;

(c) pumping said fluid at a second lower rate thereby decreasing the pressure in the wellbore and thereby removing said one or more reversible connectors; and (d) expanding said compression chamber sliding said sleeve off of said second set of flexible fins, wherein said second set of fins cleans a second portion of said wellbore.

* * * * *